US006019594A

United States Patent [19]

Denoia et al.

[11] Patent Number: 6,019,594

[45] Date of Patent: Feb. 1, 2000

[54] CHILD SAFE RETRACTION MECHANISM FOR A SMOKING MATERIAL LIGHTER

[75] Inventors: Joseph M. Denoia, Pompano Beach; Michael M. Anthony, Parkland, both of Fla.

[73] Assignee: Got-A-Lite!, Inc., Pompano Beach, Fla.

[21] Appl. No.: 09/128,307

[22] Filed: Aug. 3, 1998

Related U.S. Application Data

[63] Continuation-in-part of application No. 08/678,256, Jul. 11, 1996, Pat. No. 5,788,478.

[51] Int. Cl.[7] ..... F23D 11/36; B65H 75/48

[52] U.S. Cl. ..... 431/153; 431/253; 431/343; 131/234; 242/404; 242/913

[58] Field of Search ..... 431/253, 153, 431/277, 343; 242/382, 382.1, 384.7, 404, 913; 131/234

[56] References Cited

U.S. PATENT DOCUMENTS

| | | | |
|---|---|---|---|
| 823,761 | 6/1906 | Carleton . | |
| 1,443,993 | 2/1923 | Koster . | |
| 1,465,281 | 8/1923 | Morrison . | |
| 1,728,862 | 9/1929 | Horvath . | |
| 1,829,161 | 10/1931 | Smithson et al. . | |
| 2,732,148 | 1/1956 | Lummis | 242/107 |
| 2,860,842 | 11/1958 | Ryan | 242/107.3 |
| 2,904,282 | 9/1959 | Zelnick | 242/107 |
| 3,907,256 | 9/1975 | Kankkunen | 254/160 |
| 3,968,670 | 7/1976 | Quenot | 70/456 R |
| 4,082,496 | 4/1978 | Johnson | 431/343 |
| 4,486,169 | 12/1984 | Lewis | 431/253 |
| 4,735,377 | 4/1988 | Zuehsow | 242/107 |
| 4,898,532 | 2/1990 | Bercik | 431/253 |
| 4,927,354 | 5/1990 | Sanford | 431/253 |
| 4,953,809 | 9/1990 | Barrus | 242/107.3 |
| 5,026,274 | 6/1991 | Jacob | 431/253 |
| 5,246,183 | 9/1993 | Leyden | 242/107 |
| 5,271,730 | 12/1993 | Acacio Da Silva | 431/253 |
| 5,788,478 | 8/1998 | Denoia et al. | 431/253 |

FOREIGN PATENT DOCUMENTS

| | | | |
|---|---|---|---|
| 2399617 | 4/1979 | France | 431/343 |

*Primary Examiner*—Carl D. Price
*Attorney, Agent, or Firm*—Oltman, Flynn & Kubler

[57] ABSTRACT

A retaining apparatus includes a smoking material ignition device having a flame producing end; a holder for engagingly receiving the ignition device so that the flame producing end is exposed; a housing for releasibly receiving the holder; a spring-biased retractable cord interconnecting the holder and the housing; a child safety locking mechanism releasibly locking the holder to the housing; and a structure for mounting the housing to an object.

12 Claims, 3 Drawing Sheets

FIG. 1
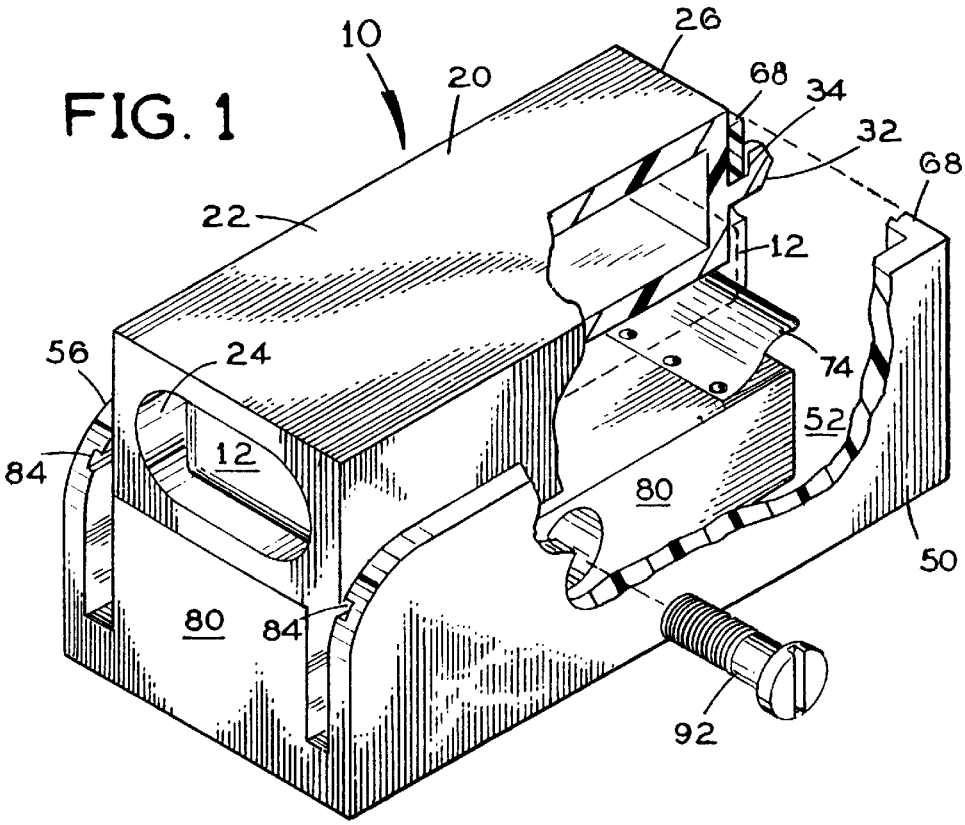
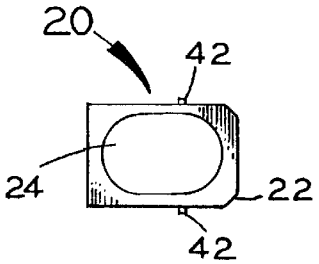
FIG. 2
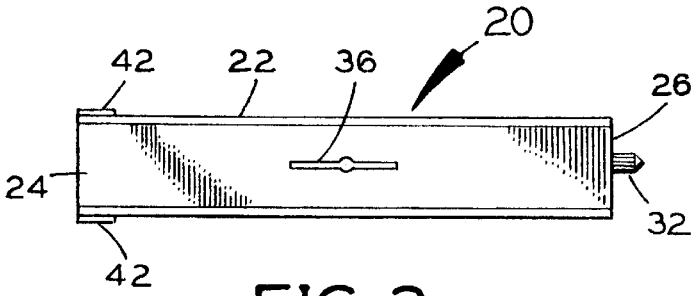
FIG. 3
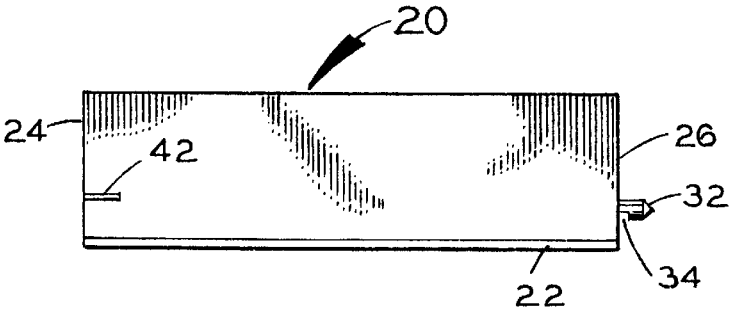
FIG. 5
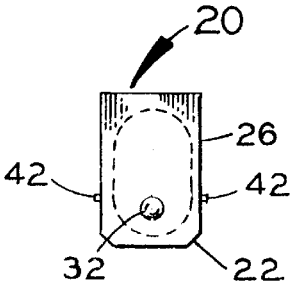
FIG. 4

CHILD SAFE RETRACTION MECHANISM FOR A SMOKING MATERIAL LIGHTER

This application is a continuation-in-part of application Ser. No. 08/678,256, filed on Jul. 11, 1996, now U.S. Pat. No. 5,788,478.

BACKGROUND OF THE INVENTION

1. Field of the Invention

The present invention relates generally to the field of smoking materials and accessories. More specifically the present invention relates to a retaining and retracting apparatus for a smoking material ignition device such as an ordinary cigarette lighter. The essential elements of the apparatus include a holder for engagingly receiving a lighter so that the flame producing end of the lighter is exposed and a housing for releasibly receiving the holder which contains a spring-biased retractable cord interconnecting the holder and housing. The housing mounts to a belt, to a building wall, boats, automobiles, etc., to an ashtray or to a floor stand which may include an ashtray.

2. Description of the Prior Art

Over the years several variations of holders for cigarette lighters have been developed. In general these holders each have included a cord on a spring-biased spool within a housing which clips onto an article of clothing. The cord is connected to the lighter and the cord retracts the lighter to the housing when released after use.

Lewis, U.S. Pat. No. 4,486,169, issued on Dec. 4, 1984, discloses a cigarette lighter securing accessory. The spring housing of Lewis is an elongate cup having the cord spool and spring in its lower end and space within its upper end to receive the retracted lighter. The housing has a clip for securing to an article of clothing. The lighter snaps into a shallow cup tied to the end of the cord. A problem with Lewis is that no provision is made for mounting to convenient stationary items such as ashtrays or to a floor stand. Another problem is that, even if such provision had been disclosed, the lighter is fully accessible to very young children.

Sanford, U.S. Pat. No. 4,927,354, issued on May 22, 1990, teaches a retractable cigarette lighter holder. The housing of Sanford is similar to a tape measure housing, and has a clothing engagement clip on one face. The lighter is releasibly received in a spring clip at the end of a cord wound on a spool within the housing and biased with a coil spring to retract the lighter into a notch in the housing forward end. Jacob, U.S. Pat. No. 5,026,274, issued on Jun. 25, 1991, reveals a holding device for a lighter which is very similar to that of Sanford. The spring and spool housing is essentially the same as that of a tape measure, except that a cup structure extends outwardly around the cord passing opening in the housing. The cup structure releasibly receives the lighter upper end to hold it in place against the housing when retracted. The remainder of the lighter is exposed for gripping by a person when the lighter is to be used. For Sanford and Jacob, the problems of Lewis are again presented.

Bercik, U.S. Pat. No. 4,898,532, issued on Feb. 6, 1990, discloses a retractable lighter apparatus similar to those of Sanford and Jacob, but additionally providing a lighter receiving cup separate from the spring housing. The spring housing and the lighter receiving cup each include a clothing engaging spring clip. The cup remains open and accessible to children at all times, as in Lewis.

Kankkunen, U.S. Pat. No. 3,907,256, issued Sep. 23, 1975, teaches a device for lowering persons and loads. Kankkunen is in some ways similar to the lighter retracting inventions described above, but is evidently built on a larger scale to retract and lift heavier items than cigarette lighters. Kankkunen offers no solutions to the problems presented by Lewis.

Other references, cited in the parent application, include Carleton, U.S. Pat. No. 823,761, issued on Jun. 19, 1908 for a harness support; Koster, U.S. Pat. No. 1,443,993, issued on Feb. 6, 1923 for an automobile lamp and cigar lighter; Morrison, U.S. Pat. No. 1,465,281, issued on Aug. 21, 1923 for a key chain reel; Horvath, U.S. Pat. No. 1,728,862, issued on Sep. 17, 1929 for a smoker's cabinet; Smithson, et al., U.S. Pat. No. 1,829,161, issued on Oct. 27, 1931 for a reel; Lummis, U.S. Pat. No. 2,732,148, issued on Jan. 24, 1956 for a retracting reel; Ryan, U.S. Pat. No. 2,860,842, issued on Nov. 18, 1958 for a wind up reel means for anchor lines; Zelnick, U.S. Pat. No. 2,904,282, issued on Sep. 15, 1959 for a spring reel measuring tape; Quenot, U.S. Pat. No. 3,968,670, issued on Jul. 13, 1976 for a security key-ring; Zuehsow, U.S. Pat. No. 4,735,377, issued on Apr. 5, 1988 for a remote control holder; Barrus, U.S. Pat. No. 4,953,809, issued on Sep. 4, 1990 for a microphone retrieval device; and Leyden, U.S. Pat. No. 5,246,183, issued on Sep. 21, 1993 for a security device for a hand-held remote control.

It is thus an object of the present invention to provide a cigarette lighter retraction apparatus which includes the essential elements of a retraction spring retaining housing, a retraction cord and a lighter engaging structure, but for which the lighter engaging structure is a holder which engages the lighter securely and over a substantial portion of the lighter surface so that the lighter cannot be manually released.

It is another object of the present invention to provide such an apparatus in which the housing and holder latch together so that a young child will not understand how to release the lighter.

It is still another object of the present invention to provide such an apparatus which includes ashtray and floor stand mounted variations and which is easy to use and is aesthetically pleasing.

It is finally an object of the present invention to provide such an apparatus which is relatively inexpensive to manufacture, sturdy and reliable.

SUMMARY OF THE INVENTION

The present invention accomplishes the above-stated objectives, as well as others, as may be determined by a fair reading and interpretation of the entire specification.

A retaining apparatus includes a smoking material ignition device having a flame producing end; a holder for engagingly receiving the ignition device so that the flame producing end is exposed; a housing for releasibly receiving the holder; a spring-biased retractable cord interconnecting the holder and the housing; a child safety locking mechanism releasibly locking the holder to the housing; and a structure for mounting the housing to an object.

The holder includes a tubular body having two longitudinal ends, one the longitudinal end being open and the other the longitudinal end being closed by a holder end wall; opposing housing engagement fins extending longitudinally along the outer surface of the tubular body; a cord engaging opening in the tubular body; where the child safety locking mechanism includes a locking projection protruding longitudinally outward from the holder end wall and including a substantially cylindrical body with a lateral hooking notch. The holder tubular body preferably includes a substantially rectangular outer cross-section and a substantially elliptical inner cross-section. The housing engagement fins preferably have a substantially triangular cross-section oriented and configured to slide laterally between resilient housing surfaces to snap into holder engagement structure with minimal resistance and to engage the holder engagement structure for higher resistance lateral removal.

The housing preferably includes a housing body having flexible side walls for laterally receiving the holder; and a cord retracting spring secured within the spring well; where the child safety locking mechanism includes the flexible side walls having longitudinal locking slots for laterally receiving the engagement fins, and containing a spring well.

Where the object is a belt, the housing preferably includes a housing body comprising a channel structure having a housing bottom wall, two laterally spaced apart and opposing housing side walls, a housing open end and a housing closed end, the housing closed end being closed by a housing end wall; and where the child safety locking mechanism includes a longitudinally opening locking port in the housing end wall sized to pass the locking projection; and a leaf spring secured to the housing body near the housing closed end to bias the locking projection hooking notch into engagement with an edge of the locking port; a housing spacer block rising from the housing bottom wall and being longitudinally separated from and spaced inwardly from the housing side walls so that the housing side walls are free to flex outwardly and resiliently against the engagement fins of the holder during holder insertion into and removal from the housing. The spacer block optionally extends from the housing open end toward the housing closed end, stopping short of the housing end wall and thereby defining a spring well within the housing body.

Where the object is one of a building wall and an ashtray and a floor stand, and where the engagement block extends the full length of the channel structure, the housing preferably additionally includes opposing slider grooves extending laterally along inside surfaces of the side walls at the housing open end; and a spacer panel removably slidable into the spacer grooves at the housing open end, for functioning in combination with the locking projection to prevent young children from dislodging the holder and lighter from the housing.

The spring well is optionally a hollow defining a chamber within the spacer block and having a cord bore through which the cord extends to the holder. The apparatus optionally additionally includes a housing wall mounting screw extending through the housing spring well and out of the housing rear face into a wall to anchor the apparatus.

The apparatus optionally additionally includes an ashtray having an ashtray bottom wall and a side wall; and a lighter support stem extending upwardly from the ashtray side wall and having a support stem free end, where the housing is secured to the support stem free end. The support stem preferably arches over the ashtray bottom wall. The ashtray preferably includes cigarette notches in the side wall. The apparatus optionally additionally includes a floor stand including a base plate for resting horizontally on a floor and a vertical support stem extending upwardly from the base plate; where the housing is mounted to the support stem.

BRIEF DESCRIPTION OF THE DRAWINGS

Various other objects, advantages, and features of the invention will become apparent to those skilled in the art from the following discussion taken in conjunction with the following drawings, in which:

FIG. 1 is a perspective, cross-sectional view of the complete apparatus, illustrating the wall mount embodiment.

FIG. 2 is an end view of the holder open end.

FIG. 3 is a cross-sectional side view of the holder.

FIG. 4 is an end view of the holder closed end, showing the locking projection.

FIG. 5 is a cross-sectional top view of the holder.

DETAILED DESCRIPTION OF THE PREFERRED EMBODIMENTS

Figure 6:
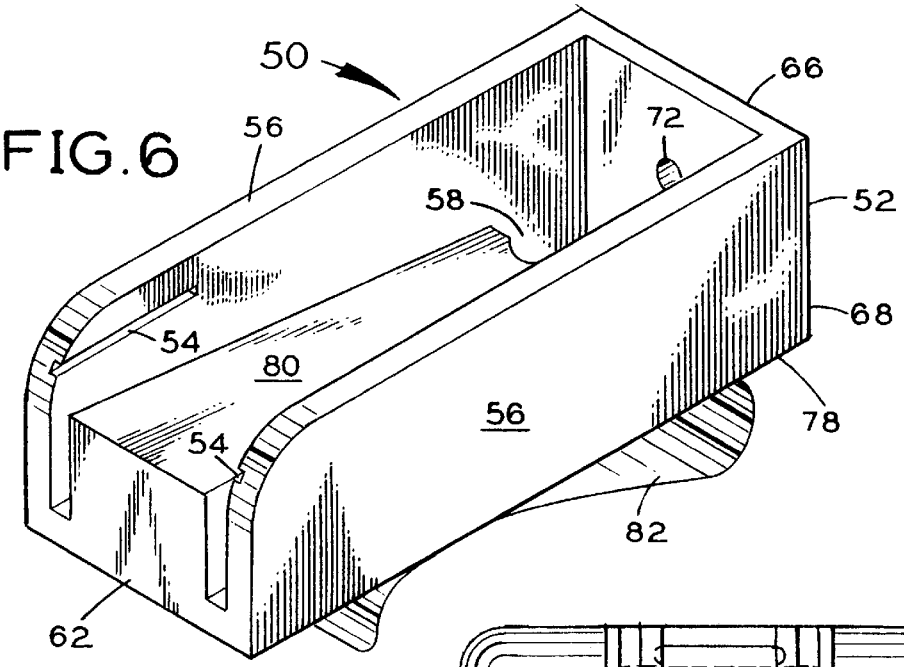
FIG. 6 is a perspective view of the belt clip embodiment of the housing, showing the locking slots and the spring well.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiments

Figure 7:
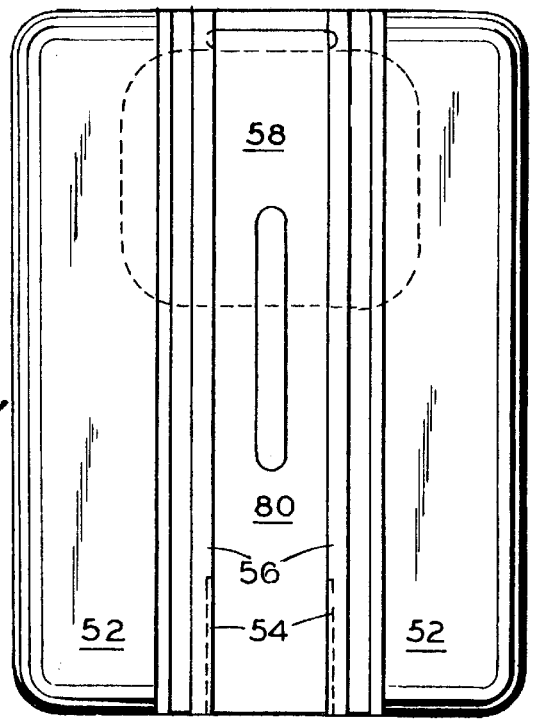
FIG. 7 is a front view of the wall mount housing embodiment.
Figure 8:
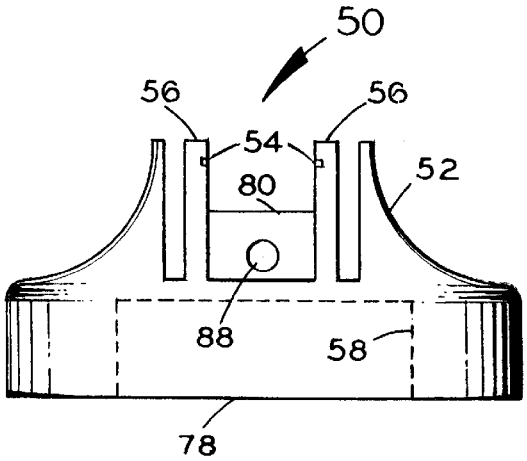
FIG. 8 is an end view of the housing of FIG. 7.
Figure 9:
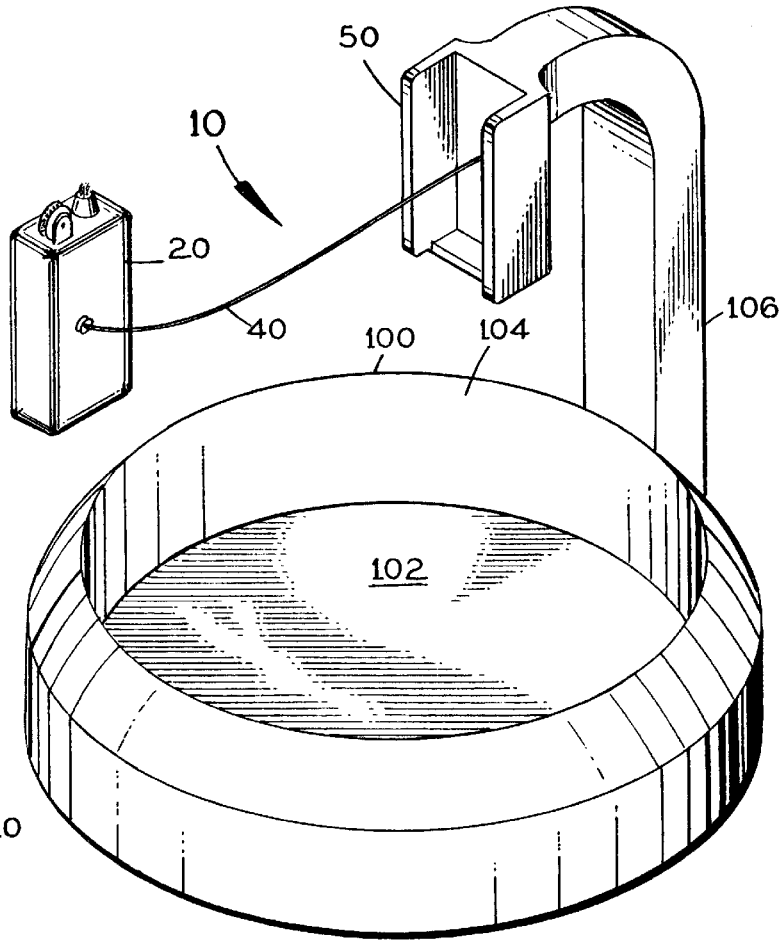
FIG. 9 is a perspective view of the ashtray mounted variation of the apparatus.
Figure 10:
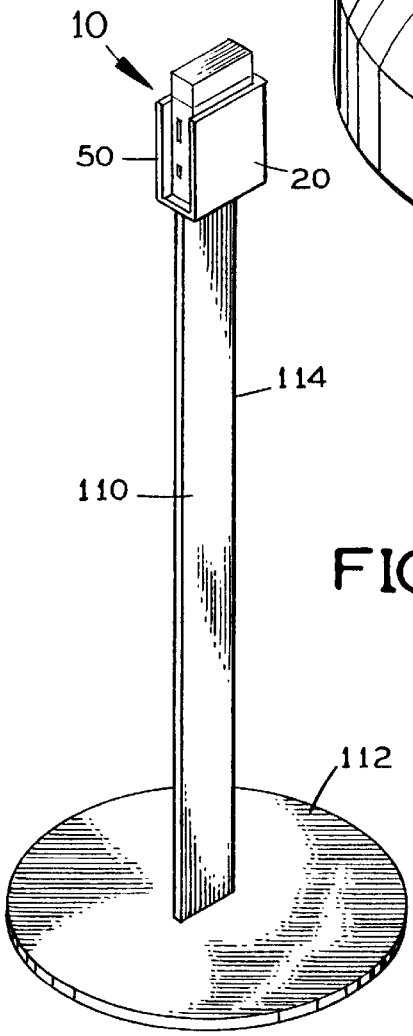
FIG. 10 is a perspective view of the floor stand mounted variation of the apparatus.

Referring to FIGS. 1–10, a retaining and retracting apparatus 10 is disclosed for a smoking material ignition device such as an ordinary cigarette lighter 12. The essential elements of apparatus 10 include a holder 20 for engagingly receiving a lighter 12 so that the flame producing end of lighter 12 is exposed, and a housing 50 for releasibly receiving holder 20 which contains a spring-biased retractable cord 40 interconnecting holder 20 and housing 50. Housing 50 mounts to a belt, to a building wall, to an ashtray or to a floor stand, which may include an ashtray.

For all preferred embodiments, holder 20 preferably includes an elongate tubular body 22 having a rectangular outer cross-section and an elliptical inner cross-section, one longitudinal end being an open end 24 and the other longitudinal end being closed end 28 with a holder end wall 26. A locking projection 32 protrudes longitudinally outward from holder end wall 26 and includes a generally cylindrical body with a tapered free end and an upwardly opening, lateral hooking notch 34. A centrally positioned, cord engaging slot 36 is provided in tubular body 22, and opposing housing engagement fins 42 extend longitudinally along the body 22 outer surface from the holder open end 24. Fins 42 have a triangular cross-section to slide laterally between resilient housing 50 surfaces to snap into locking slots 54 in housing 50 with minimal resistance, and to engage locking slots 54 for higher resistance lateral removal.

Housing 50 preferably includes a housing body 52 having flexible side walls 56 with the longitudinal locking slots 54 for laterally receiving holder 20, and including a spring well 58 containing a cord retracting spring within a spring casing 60, and means for connection to another object.

For the belt clip embodiment, housing body 52 is an elongate channel structure which includes a housing bottom wall 62, two spaced housing side walls 56, a housing body open end 64 and a housing body closed end 68, which is closed by a housing body end wall 66. Housing body end wall 66 has a longitudinally oriented locking port 72 sized to closely receive locking projection 32, and a leaf spring 74 is provided within housing body 52 near closed end 68 to bias holder 20 and locking projection hooking notch 34 into engagement with the port 72 edge. The thickness of housing body end wall 66 is sized such that hooking notch 34 fits closely around and engages the port 72 edge of end wall 66. Locking projection 32 and port 72 form a child guard protection mechanism preventing young children from understanding how to remove holder 20 from housing 50. An integral spacer block 80 rises from housing body bottom wall 62 and is longitudinally separated from and spaced inwardly from side walls 56 so that side walls 56 are free to flex outwardly against fins 42 during holder 20 insertion and removal.

For the belt clip embodiment, block 80 extends from open end 64 toward closed end 68, stopping sufficiently short of end wall 66 to define a spring well 58. Housing side walls 56 are optionally rounded at housing body open end 64 for aesthetic purposes. A belt spring clip 82 is fastened to housing rear face 78.

For the embodiment mounted to the wall, to an ashtray 100 and to a floor stand 110, protection against child access become most critical. For these, block 80 extends the full length of the housing 50 channel structure, and opposing slider grooves 84 are provided in side walls 56 at open end 64. A sliding gate 86 removably slides into the sliding gate grooves 84 at open end 64, and serves as a child guard feature in conjunction with locking projection 32 so that young children cannot dislodge lighter 12 and holder 20 from housing 50. Gate 86 may alternatively pivot on housing 50. Spring well 58 is in this instance a chamber contained within block 80 having a cord bore 88 through which cord 40 extends from spring casing 60 to holder 20.

The wall mount embodiment includes a mounting screw 92 which extends through housing spring well 58, through a central port P provided by the manufacturer in the spring casing 60, and out of the housing rear face 78 into a wall to anchor apparatus 10. The ashtray embodiment includes an ashtray 100 of conventional design, having a broad bottom wall 102 and a relatively short side wall 104, optionally with cigarette notches (not shown). See FIG. 9. A lighter support stem 106 extends upwardly from ashtray side wall 104, arching over ashtray 100, and housing 50 is secured vertically to the free end of support stem 106 with glue or other means. The floor stand embodiment includes a base plate 112 for resting horizontally on the floor and a vertical support stem 114 extending upwardly from base plate 112 to a height conveniently reached by adult persons who are standing. See FIG. 10. Housing rear face 78 is mounted vertically against the side of support stem 114 at this convenient height, once again with glue or with other means. An ashtray 100 optionally extends from support stem 114 just below the housing 50.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim as our invention:

1. A retaining apparatus comprising:

a smoking material ignition device having a flame producing end;

a holder for engagingly receiving said ignition device such that said flame producing end is exposed;

a housing for releasably receiving said holder;

a spring-biased retractable cord interconnecting said holder and said housing;

child safety locking means releasably locking said holder to said housing;

and means for mounting said housing to an object;

wherein said holder comprises a tubular body having two longitudinal ends, one said longitudinal end being open and the other said longitudinal end being closed by a holder end wall;

opposing housing engagement fins extending longitudinally along the outer surface of said tubular body;

a cord engaging opening in said tubular body;

wherein said child safety locking means comprises a locking projection protruding longitudinally outward from said holder end wall and including a substantially cylindrical body with a lateral hooking notch.

2. An apparatus according to claim 1, wherein said holder tubular body comprises a substantially rectangular outer cross-section and a substantially elliptical inner cross-section.

3. An apparatus according to claim 1, wherein said housing engagement fins have a substantially triangular cross-section oriented and configured to slide laterally between resilient housing surfaces to snap into holder engagement means with minimal resistance and to engage said holder engagement means for higher resistance lateral removal.

4. An apparatus according to claim 1, wherein said housing comprises:

a housing body having flexible side walls for laterally receiving said holder;

and a cord retracting spring secured within said spring well;

wherein said child safety locking means comprises said flexible side walls having longitudinal locking slots for laterally receiving said engagement fins, and containing a spring well.

5. An apparatus according to claim 4, wherein said spring well is a hollow defining a chamber within said spacer block and having a cord bore through which said cord extends to said holder.

6. An apparatus according to claim 4, additionally comprising a housing wall mounting screw extending through said housing spring well and out of said housing rear face into a wall to anchor said apparatus.

7. An apparatus according to claim 1, wherein said object is a belt, said housing comprising:

a housing body comprising a channel structure having a housing bottom wall, two laterally spaced apart and opposing housing side walls, a housing open end and a housing closed end, said housing closed end being closed by a housing end wall;

and wherein said child safety locking means comprises a longitudinally opening locking port in said housing end wall sized to pass said locking projection;

and a leaf spring secured to said housing body near said housing closed end to bias said locking projection hooking notch into engagement with an edge of said locking port;

a housing spacer block rising from said housing bottom wall and being longitudinally separated from and spaced inwardly from said housing side walls such that said housing side walls are free to flex outwardly and resiliently against said engagement fins of said holder during holder insertion into and removal from said housing.

8. An apparatus according to claim 7, wherein said spacer block extends from said housing open end toward said housing closed end, stopping short of said housing end wall and thereby defining a spring well within said housing body.

9. An apparatus according to claim 1, wherein said object is one of a building wall and an ashtray and a floor stand, and wherein said engagement block extends the full length of said channel structure, said housing additionally comprising:

opposing slider grooves extending laterally along inside surfaces of said side walls at said housing open end;

and a spacer panel removably slidable into said spacer grooves at said housing open end, for functioning in combination with said locking projection to prevent young children from dislodging said holder and lighter from said housing.

10. A retaining apparatus comprising:

a smoking material ignition device having a flame producing end;

a holder for engagingly receiving said ignition device such that said flame producing end is exposed;

a housing for releasably receiving said holder:

a spring-biased retractable cord interconnecting said holder and said housing;

child safety locking means releasably locking said holder to said housing;

and means for mounting said housing to an object;

additionally comprising:

an ashtray having an ashtray bottom wall and a side wall;

a lighter support stem extending upwardly from said ashtray side wall and having a support stem free end, wherein said housing is secured to said support stem free end.

11. An apparatus according to claim 10, wherein said support stem arches over said ashtray bottom wall.

12. An apparatus according to claim 10, wherein said ashtray comprises cigarette notches in said side wall.

* * * * *